US006538527B2

(12) United States Patent
Hidaka et al.

(10) Patent No.: US 6,538,527 B2
(45) Date of Patent: Mar. 25, 2003

(54) RESONATOR, FILTER, DUPLEXER, AND COMMUNICATION DEVICE

(75) Inventors: Seiji Hidaka, Nagaokakyo (JP); Michiaki Ota, Kyoto (JP); Shin Abe, Muko (JP)

(73) Assignee: Murata Manufacturing Co. Ltd. (JP)

( * ) Notice: Subject to any disclaimer, the term of this patent is extended or adjusted under 35 U.S.C. 154(b) by 0 days.

(21) Appl. No.: 09/750,947

(22) Filed: Dec. 28, 2000

(65) Prior Publication Data

US 2001/0043129 A1 Nov. 22, 2001

(30) Foreign Application Priority Data

Dec. 28, 1999 (JP) ..... 11-375194

(51) Int. Cl.[7] ..... H01P 7/10

(52) U.S. Cl. ..... 333/99.005; 333/219; 333/202; 505/210

(58) Field of Search ..... 333/202, 219, 333/995, 238; 505/210

(56) References Cited

U.S. PATENT DOCUMENTS 4,061,992 A 12/1977 Inokuchi ..... 333/73 R
4,680,560 A 7/1987 Yorita et al. ..... 333/206
5,172,085 A 12/1992 Glenat et al. ..... 333/222
5,905,420 A 5/1999 Tsujiguchi et al. ..... 333/206
5,932,522 A * 8/1999 Bell et al. ..... 505/210

FOREIGN PATENT DOCUMENTS

GB 632834 * 12/1949 ..... 333/238
GB 1532895 11/1978
GB 2217921 A 1/1989
JP 429207 3/1992
JP 7122914 5/1995

OTHER PUBLICATIONS

United Kingdom Search Report issued May 29, 2001 in a related application.

JP Office Action dated Apr. 30, 2002 with English Translation.

* cited by examiner

*Primary Examiner*—Robert Pascal
*Assistant Examiner*—Joseph Chang
(74) *Attorney, Agent, or Firm*—Dickstein, Shapiro, Morin & Oshinsky, LLP.

(57) ABSTRACT

A resonator includes a hollow dielectric element having a hole therein, a helical line unit including a plurality of helical lines formed in the hole, and a ground electrode formed on an outer surface of the dielectric element.

16 Claims, 18 Drawing Sheets

RESONATOR, FILTER, DUPLEXER, AND COMMUNICATION DEVICE

BACKGROUND OF THE INVENTION

1. Field of the Invention

The present invention generally relates to microwave or millimeter-wave communication devices, and more particularly to a resonator, a filter, a duplexer, and a communication device for use in transmission and reception of radio waves or electromagnetic waves.

2. Description of the Related Art

Typically, resonators used in the microwave or millimeter-wave band incorporate a coaxial resonator including a dielectric block having a through-hole formed therein, an inner conductor formed within the through-hole, and an outer conductor formed on an outer surface of the dielectric block.

Compact dielectric coaxial resonators of this type have been proposed in Japanese Utility Model Application Publication No. 4-29207 and Japanese Unexamined Patent Application Publication No. 7-122914. The proposed dielectric coaxial resonators are of the type in which the inner conductor is spiral-shaped so that the axial length of the through-hole is reduced.

A typical coaxial resonator having a spiral inner conductor is a resonator formed either by a half-wave or quarter-wave line made from a single spiral micro-strip line. In such a typical coaxial resonator, therefore, a region in which the electric energy is concentrated and accumulated and a region in which the magnetic energy is concentrated and accumulated are separately and unevenly distributed. More specifically, the electric energy is accumulated in the vicinity of an open end of the line while the magnetic energy is accumulated in the vicinity of a short-circuit end of the line.

The resonator having a resonant line formed by a single micro-strip line encounters problems, in that the micro-strip line suffers from degradation of its characteristics due to the edge effect which inherently affects micro-strip lines. That is, the electric current is concentrated at the edges of the line as viewed at the cross-section of the line, that is, both ends in its width direction, and the upper and lower ends in its thickness direction. Even if the thickness of the line is increased in order to suppress power loss due to such current concentration, the edge regions in which the current concentration occurs will not be increased in size. Thus, a problem which is essentially associated with power loss due to the edge effect occurs. Accordingly, while the use of a spiral inner conductor makes it possible to reduce the axial length of the through-hole to, for example, approximately 15% of the length in the above-mentioned Japanese applications, the unloaded Q-factor is strongly deteriorated to a value of 55, as compared to a typical unloaded Q-factor of 470.

SUMMARY OF THE INVENTION

Responding to these problems, the present invention provides a resonator, a filter, a duplexer, and a communication device which have low loss characteristics and are compact, and in which power loss due to the edge effect is effectively suppressed.

To this end, in one aspect of the present invention, a resonator includes a hollow dielectric element having a hole therein, a helical line unit including a plurality of helical lines formed in the hole, and a ground electrode formed on an outer surface of the dielectric element.

With this structure, each helical line is adjacent to another helical line. Microscopically, the edge effect in the helical lines is physically significant, and the helical lines slightly suffer from the edge effect. Macroscopically, however, as these helical lines are considered together as a single helical line unit, each helical line neighbors another helical line, so that the edges of the helical lines in their width direction are essentially continuous. That is, the edge effect becomes negligible. Therefore, the current concentration at the edges of each line due to the edge effect is moderated extremely efficiently, to significantly suppress power loss.

In another aspect of the present invention, a resonator includes a cylindrical base comprising an insulator, a magnetic element or a dielectric element, and a helical line unit including a plurality of helical lines arranged on a lateral face of the cylindrical base, and these are installed in a cavity to form the resonator. Structurally, the helical line unit is identified as a central conductor of a coaxial resonator.

In another aspect of the present invention, a resonator may include a conductive shielding member. The conductive shielding member is used to confine the electromagnetic energy within a certain region, preventing unwanted emission or unwanted coupling to the outside.

In the above resonators, the helical lines are preferably interconnected by a line at a substantially equi-phase region. This provides a uniform potential at the interconnected region of the helical lines, so that the resonator including the helical lines resonates in a desired resonant mode in a stable manner, suppressing spurious responses. Since the helical lines are interconnected by a line to form a single helical line unit, a large capacitance is readily generated between a coupling electrode and the helical line unit, thereby providing strong coupling to an external circuit.

In another aspect of the present invention, a filter includes a hollow dielectric element having a plurality of holes therein and a plurality of resonators having different axes and being arranged substantially in parallel to each other. The resonators include a plurality of helical line units each including a plurality of helical lines formed in each of the holes, and a ground electrode formed on an outer face of the dielectric element. The filter further includes input/output units coupled to predetermined resonators of the plurality of resonators. Accordingly, the filter has multiple resonators coupled to each other.

In another aspect of the present invention, a filter includes a conductive cavity, and a plurality of resonators arranged in the conductive cavity so as to have different axes substantially in parallel to each other. The resonators include a plurality of helical line units each formed on a lateral face of a cylindrical base, each helical line unit including a plurality of helical lines. The filter further includes input/output units coupled to predetermined resonators of the multiple resonators. Accordingly, the filter has multiple resonators coupled to each other.

In another aspect of the present invention, a filter includes a cylindrical dielectric element having a hole therein and a plurality of resonators. The resonators include a plurality of helical line units coaxially formed in the hole, each helical line unit including a plurality of helical lines and a ground electrode formed on an outer face of the dielectric element. The filter further includes input/output units coupled to predetermined resonators of the plurality of resonators. Accordingly, the filter has multiple resonators coupled to each other.

In another aspect of the present invention, a filter includes a conductive cavity, and a plurality of resonators coaxially arranged in the conductive cavity. The resonators include a plurality of helical line units each formed on a lateral face of a cylindrical base, each including a plurality of helical lines. The helical line units are formed on a lateral face of cylindrical base. The filter further includes input/output units coupled to predetermined resonators of the multiple resonators. Accordingly, the filter has multiple resonators coupled to each other.

In another aspect of the present invention, a duplexer uses one of the previously-described filters. In other words, any of the previous fillers may be used in the duplexer, for example as a transmitter filter and a receiver filter in a shared transmitter/receiver device such as a shared antenna device.

In another aspect of the present invention, a communication device uses one of the previously-described filters or the duplexer. Therefore, insertion losses into a high frequency transmitter/receiver are reduced while communication quality such as low-noise characteristics or transmission speed is improved.

Other features and advantages of the present invention will become apparent from the following description of the invention which refers to the accompanying drawings, in which like references denote like elements and parts.

DESCRIPTION OF EMBODIMENTS OF THE INVENTION

A resonator according to a first embodiment of the present invention is described with reference to FIGS. 1 to 7.

Figure 1A:
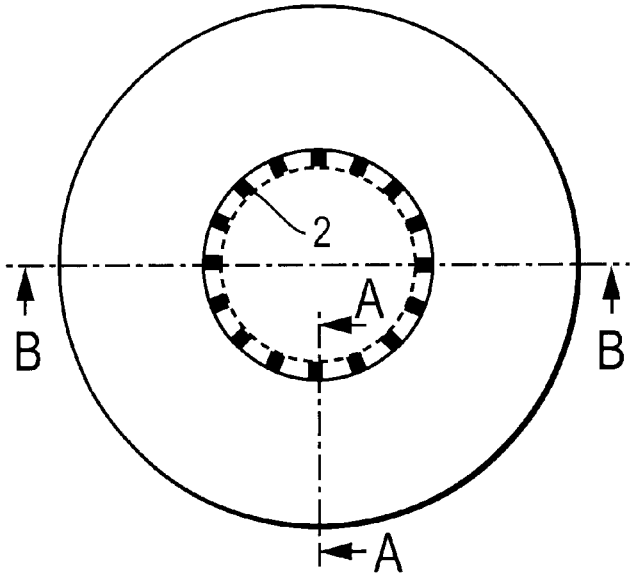
FIG. 1 A is a top plan view of a resonator according to a first embodiment of the present invention.
FIG. 1B is a cross-sectional view of the resonator taken along the line B—B in FIG. 1A.
Figure 1B:
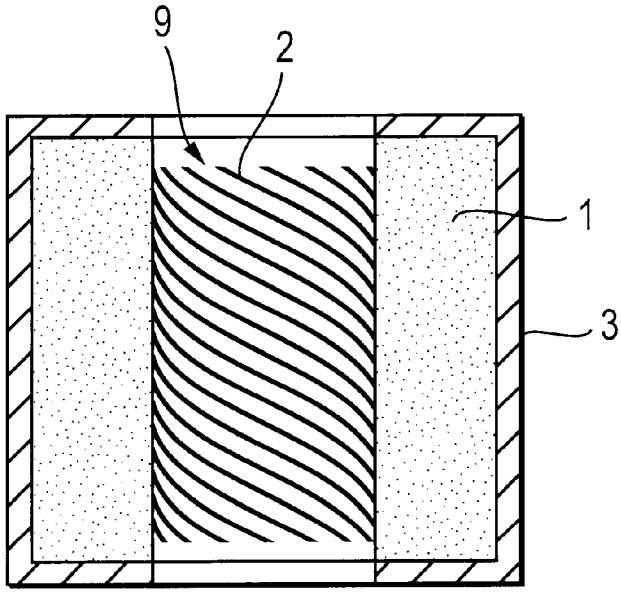
Figure 2:
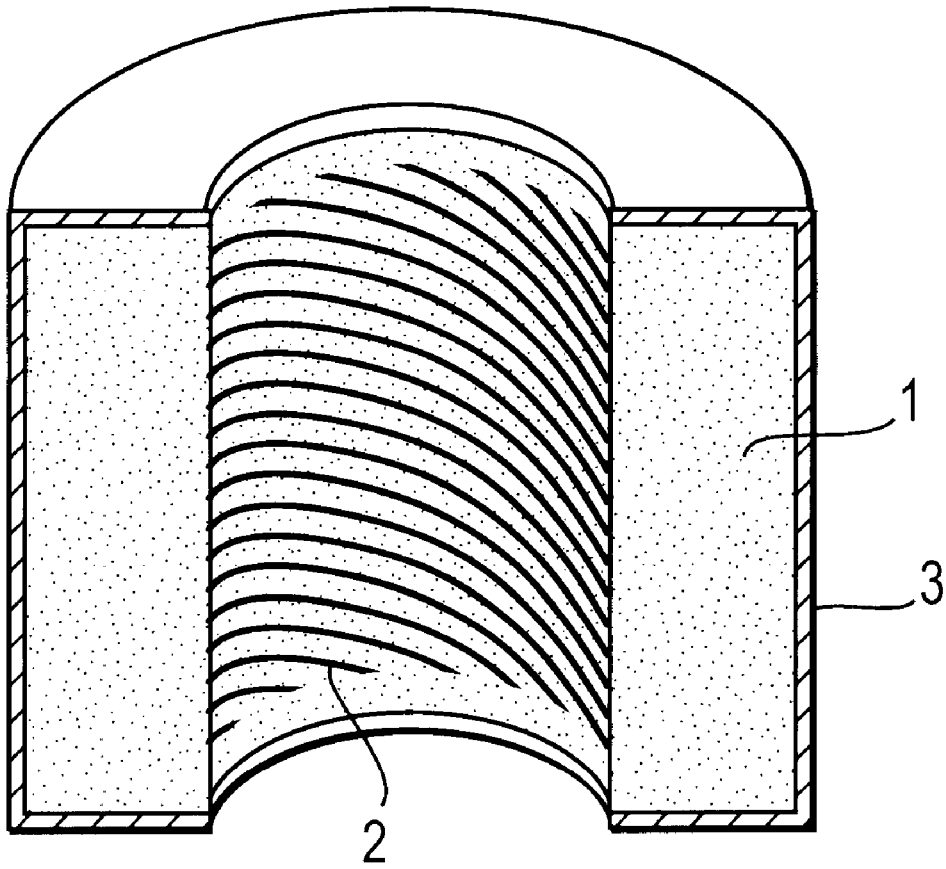
FIG. 2 is a cut-away perspective view of the resonator.

FIGS. 1A and 1B are a top plan view and a cross-sectional view of a resonator according to the first embodiment. FIG. 2 is a cut-away perspective view thereof.

In the illustrated example, a hollow cylindrical dielectric element 1 has a hole 9. A plurality of helical lines 2 are formed in the hole 9, and a ground electrode 3 is formed on the outer surface of the dielectric element 1. Each of the helical lines 2 serves as a half-wave resonant line having open ends, and adjacent helical lines are coupled to each other by mutual induction and capacitance. The helical lines collectively form a single helical line unit, which becomes a central conductor of a coaxial resonator. A resonator of this type thus includes a central conductor formed of a multiple helical line unit and having open ends, wherein predetermined stray capacitance is generated between the open ends and the ground.

It is not necessary that the ground electrode 3 is formed on the ends of the cylindrical dielectric element 1; the ends of the dielectric element 1 may be open.

The ground electrode 3 formed on the ends of the dielectric element 1, as shown in FIGS. 1A, 1B and 2, prevents unwanted emission and unwanted coupling of the electromagnetic field to the outside. In addition, since stray capacitance between the open ends of the multiple helical line unit and the ground electrode 3 reduces the resonant frequency, the axial length of the resonator necessary to obtain a desired resonant frequency is reduced by forming the ground electrode 3 on the ends of the dielectric element 1 as shown in FIGS. 1A, 1B and 2.

The dielectric element 1 as shown in FIGS. 1A, 1B and 2 may be a dielectric made of a magnetic material.

Figure 3A:
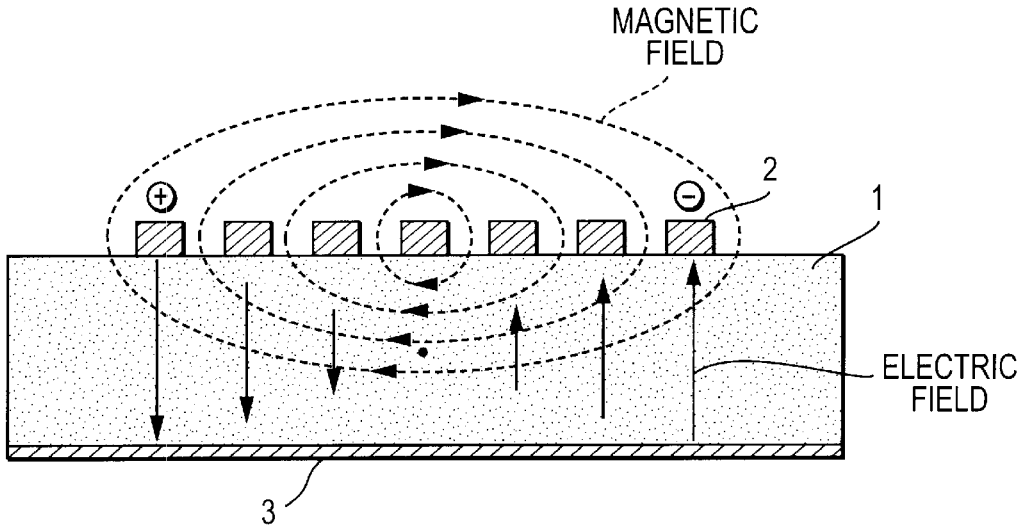
FIGS. 3A and 3B are cross-sectional views of the resonator taken along the line A—A of FIG. 1A, showing an example of the electromagnetic field distribution.
Figure 3B:
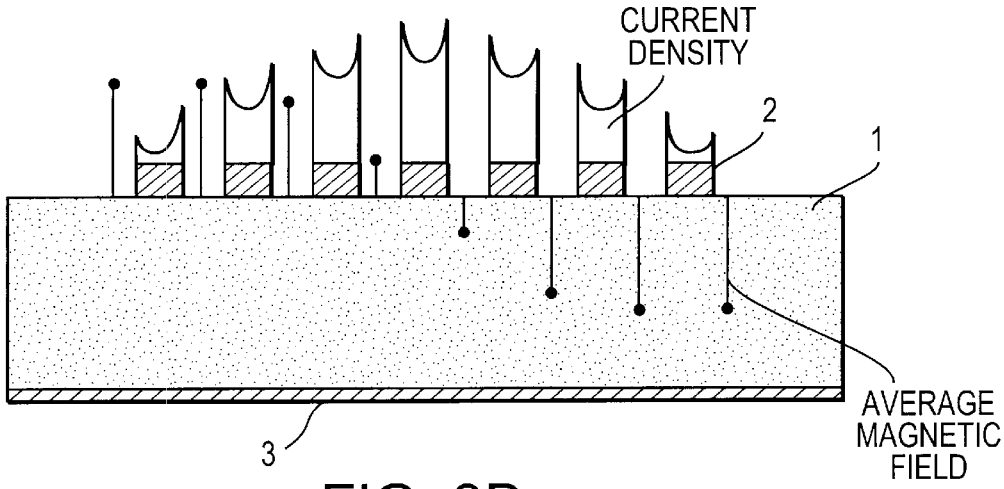

FIGS. 3A and 3B illustrate an example of the electromagnetic field distribution and electric current in an electrode pattern having a plurality of helical lines (hereinafter sometimes collectively referred to as "multiple helical line unit") arranged thereon. FIG. 3A is a cross-sectional view of the multiple helical line unit taken along the line A—A of FIG. 1A, showing the electric field and magnetic field distribution at the moment when the charge at the inner and outer circumferential edges of the line unit is maximum. FIG. 3B is a cross-sectional view of the multiple helical line unit taken along the line A—A of FIG. 1A, showing the current density of the lines, and the average magnetic field which extends between the lines in the direction of the thickness of the dielectric element 1.

Microscopically, the current density is greater at the edges of each line, as shown in FIG. 3B. As viewed through the axial direction of the hole 9 (in the horizontal direction of FIG. 3B), however, at the right and left edges of each single helical line, spaced a predetermined distance therefrom, additional conductor lines are formed, through which electric current flows having the same amplitude and phase as in said single helical line, thereby reducing the edge effect. In other words, if the helical line unit is regarded as a single line, the distribution of electric density in the line unit forms substantially a sine curve, in which the inner and outer circumferential edges form nodes and the center forms a peak. Macroscopically, therefore, the edge effect is prevented.

Figure 4A:
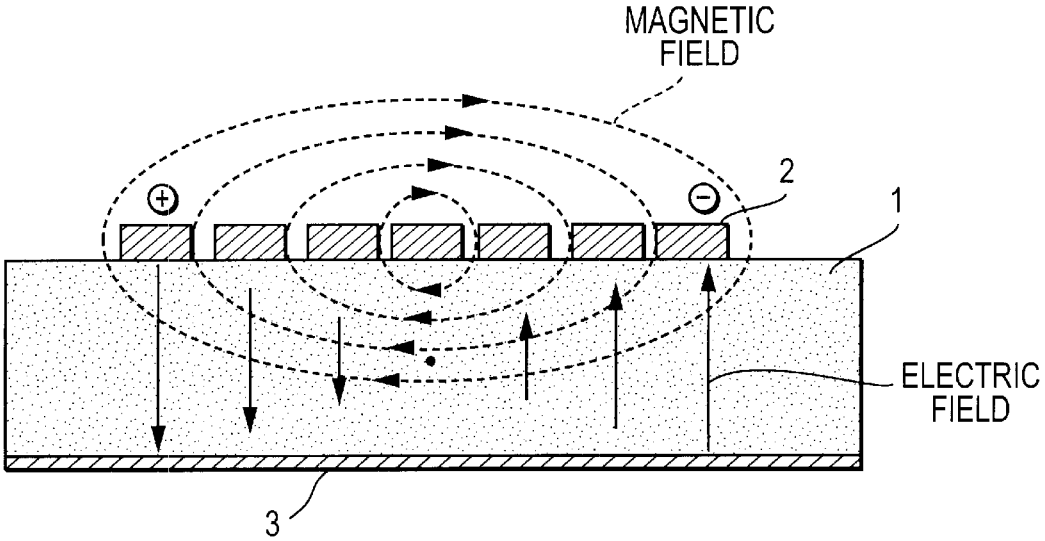
FIGS. 4A and 4B are cross-sectional views similar to the views in FIGS. 3A and 3B, showing a comparative example of the electromagnetic field distribution.
Figure 4B:
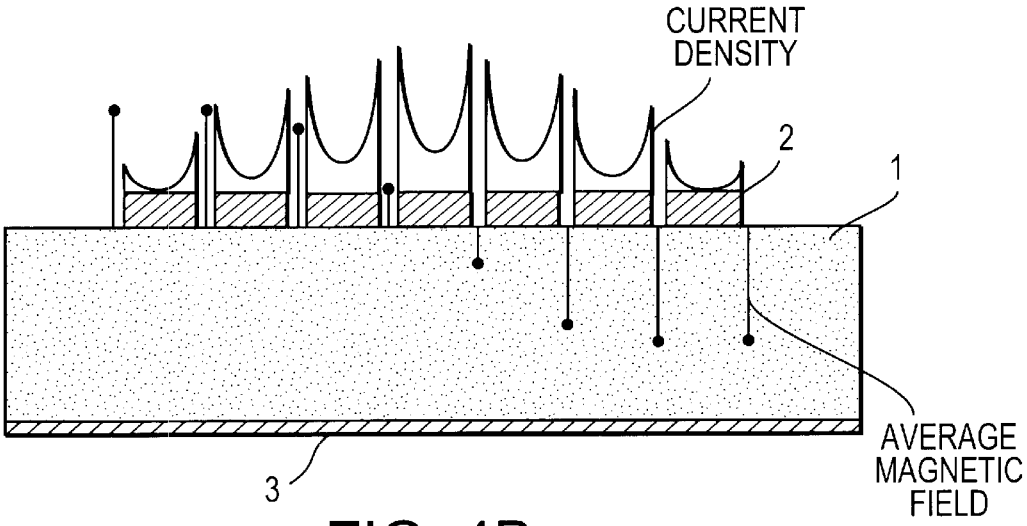

FIGS. 4A and 4B show a comparative example in which the line width of each line shown in FIGS. 3A and 3B is increased to several times the skin depth. It can be seen in FIGS. 4A and 4B that increasing the line width would cause an increase in the current concentration in the conductors due to the edge effect to occur, thereby diminishing the loss-reducing effect of the invention.

The electromagnetic field distributions shown in FIGS. 3A, 3B, 4A and 4B are not inherently obtained until a three-dimensional analysis is performed. The computation for the analysis is extremely intensive, and thus a smaller model is used for simulation instead of a full-scaled model. The results are described below.

Figure 5A:
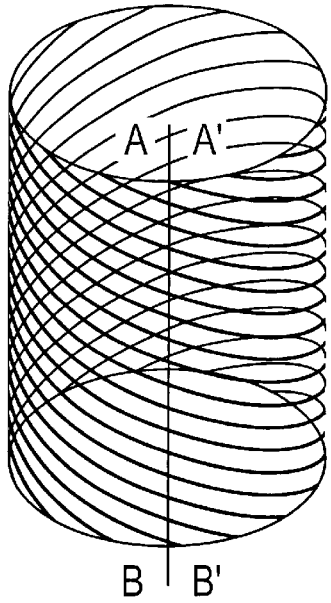
FIG. 5A is a perspective view showing an analysis model of a multiple helical line unit.
Figure 5B:
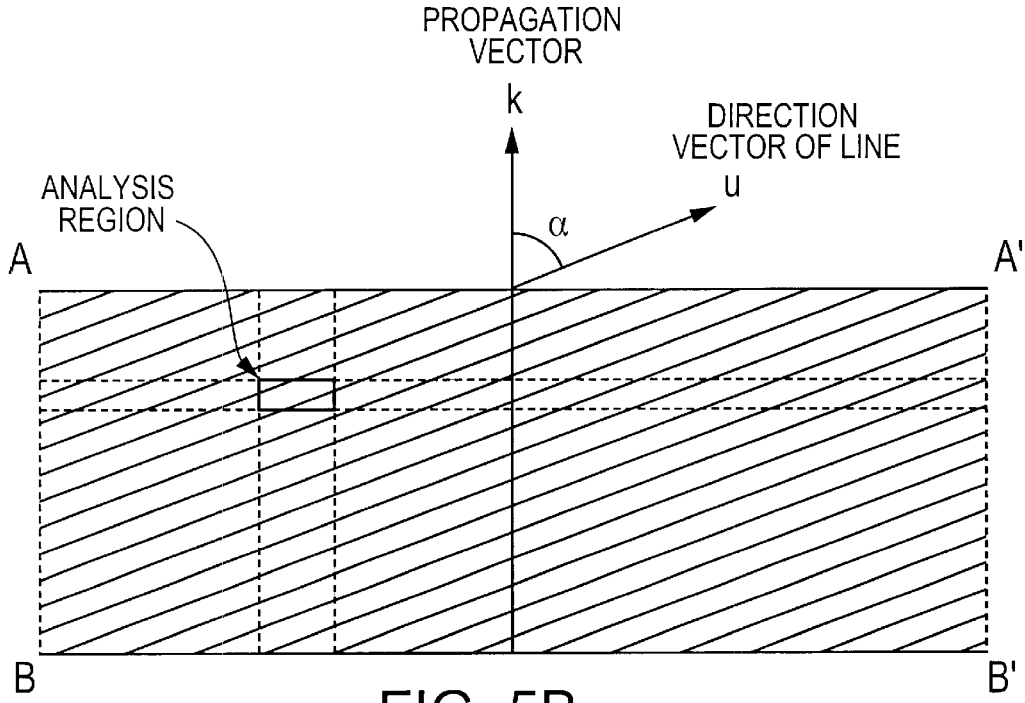
FIG. 5B is a development view of the analysis model.
Figure 6:
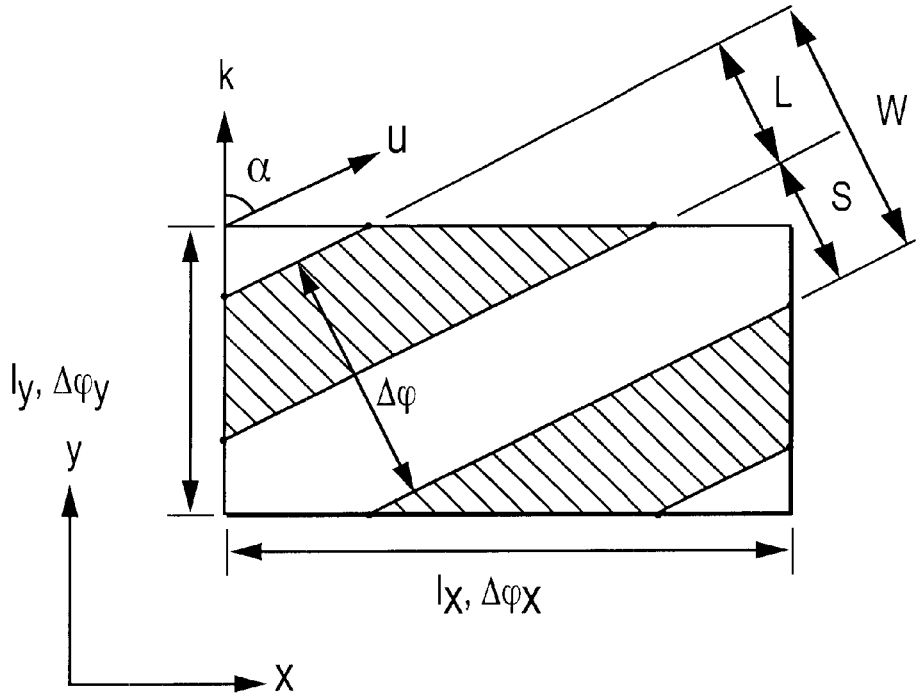
FIG. 6 is an enlarged view of an analysis region shown in FIG. 5B.

FIGS. 5A, 5B, and 6 illustrate a simulation model which describes the relationship between the line spacing and the Q factor of the multiple helical line unit. FIG. 5A is a perspective view only showing the multiple helical line unit, and FIG. 5B shows the multiple helical line unit which is developed along the lines A–B and A'–B' on a two-dimensional plane. In FIG. 5B, $\alpha$ is an angle formed between the propagation vector k and the traveling direction vector u of the lines.

FIG. 6 is an enlarged view of an analysis region indicated in FIG. 5B. The line width is indicated by L, the spacing between the lines is indicated by S, and the array pitch of the lines is indicated by W. The analysis region is defined as the minimum region that satisfies a dual-period boundary condition having a physical boundary condition in which the cross-sectional form in: the x- and y-directions is identical, and an electrical boundary condition which is generalized so as to be applicable to any phase difference. Therefore, the range of the analysis region is expressed by the following equations:

$$l_x = W/\cos\alpha$$

$$\Delta\phi_x = 0$$

$$l_y = W/\sin\alpha$$

$$\Delta\phi_y = \Delta\phi/\sin^2\alpha$$

where $l_y$ is the distance in the propagation vector k direction (y-direction), $\Delta\phi_y$ is the phase difference in the y-direction, $l_x$ is the distance in the x-direction perpendicular thereto, and $\Delta\phi_x$ is the phase difference in the x-direction.

The parameters of the analysis region are defined as follows. Computational conditions Electrode

| | |
|---|---|
| Thickness | t = 5 $\mu$m |
| Line width | L = W/2 |
| Space | S = W/2 |
| Pitch W | (variable) |
| Line length | $L_{tot}$ = 11.75 mm |

Phase difference between the lines $\Delta\phi$(variable) angle $\alpha$=87.6°

Dielectric element

| | |
|---|---|
| Relative permittivity | $\epsilon_r$ = 80 |
| Dielectric loss tangent | tan $\delta$ = 0 |
| Height | H = 100 $\mu$m |

It will be noted that the electrode pitch W and the angle $\alpha$ of the lines are expressed as follows.

$$W = L + S$$

$$\alpha = \tan^{-1}(\Delta\phi/\pi)(L_{tot}/W)$$

The change in the Q factor as W is modified is shown in Table 1 as follows.

TABLE 1

| W [$\mu$m] | $\Delta\phi$ | Q |
|---|---|---|
| 1 | 0.36 | 79.7 |
| 2 | 0.72 | 78.1 |
| 3 | 1.08 | 75.6 |
| 4 | 1.44 | 72.4 |
| 5 | 1.80 | 68.8 |

Figure 7:
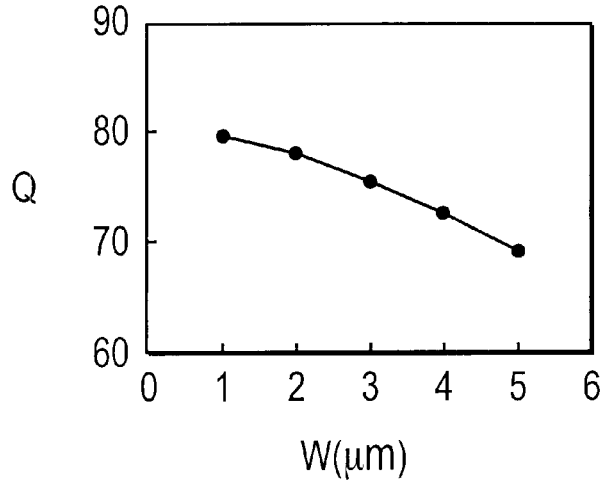
FIG. 7 is a chart showing the relationship between the array pitch W of multiple helical lines and the Q factor of the resonator.

FIG. 7 is a chart showing the relationship between the pitch W and the Q factor shown in Table 1.

When the line width L is variable while keeping the propagation angle a constant, the lower the line width L, the greater the number of lines. For example, in the case where a line width of 4 $\mu$m is reduced to 2 $\mu$m, the number of lines is doubled.

As is apparent from the previous calculation result, the narrower the line width or the higher the number of lines, the greater the Q factor. It is to be noted that in this example the calculation result up to a line width of 5 $\mu$m is presented, because a relatively broad line width will be more susceptible to degradation due to the edge effect and the desired computational accuracy may not be obtained. It should further be noted that the Q factor in the above calculation result does not correspond to the actual Q-factor of a resonator according to the first embodiment, since a smaller model was simulated.

Accordingly, reducing the line width of each helical line and increasing the number of lines improves losses due to the edge effect, thereby attaining a resonator having a high Q-factor. Typically, a coaxial resonator has the same Q-factor regardless of whether the central conductor is formed of a cylindrical conductor film or a prism-shaped conductor bar. According to the first embodiment, the inner space of the hole 9 formed in the dielectric element 1 further contributes to the resonance space, whereby the current concentration is moderated, resulting in a high Q-factor.

A resonator according to a second embodiment of the present invention is now described with reference to FIGS. 8A to 8C and 9.

Figure 8A:
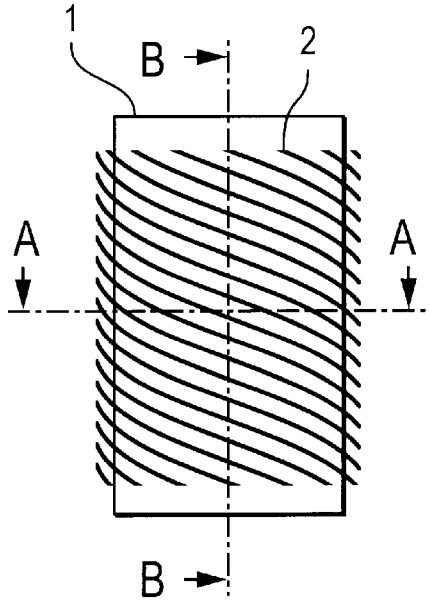
FIG. 8A is a front view of a resonator according to a second embodiment of the present invention.
Figure 8B:
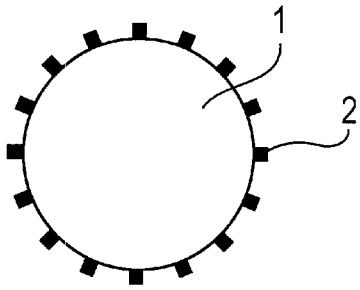
FIGS. 8B and 8C are cross-sectional views of the resonator taken along the lines A—A and B—B of FIG. 8A, respectively.
Figure 8C:
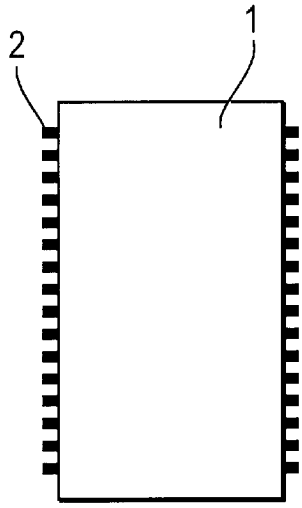
Figure 9:
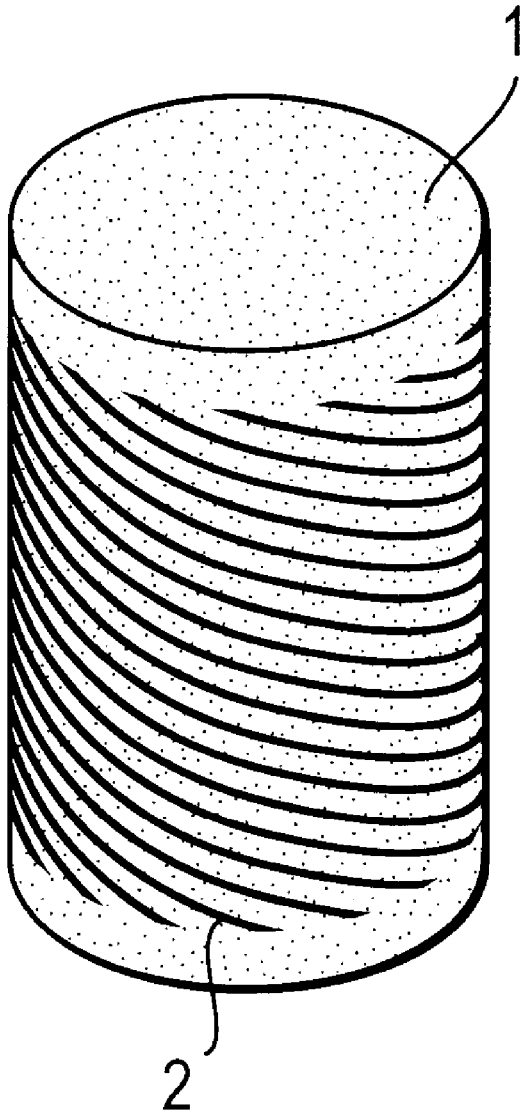
FIG. 9 is a perspective view of the resonator shown in FIGS. 8A to 8C.

FIG. 8A is a front view of the resonator. FIGS. 8B and 8C are cross-sectional views of the resonator taken along the lines A—A and B—B of FIG. 8A, respectively. FIG. 9 is a perspective view of the resonator.

In the illustrated example, a plurality of helical lines 2, which form a multiple helical line unit, are arranged on a surface of a cylindrical dielectric element 1. Each of the helical lines 2 serves as a half-wave resonant line having open ends, and adjacent helical lines are coupled to each other by mutual induction and capacitance. The helical lines collectively. form a single inner conductor, which becomes a central conductor of a coaxial resonator.

In FIGS. 8A to 8C, the cylindrical dielectric element I is employed as a base on which the helical lines 2 are formed. However, the base may be replaced by an insulator or a magnetic element.

Figure 10A:
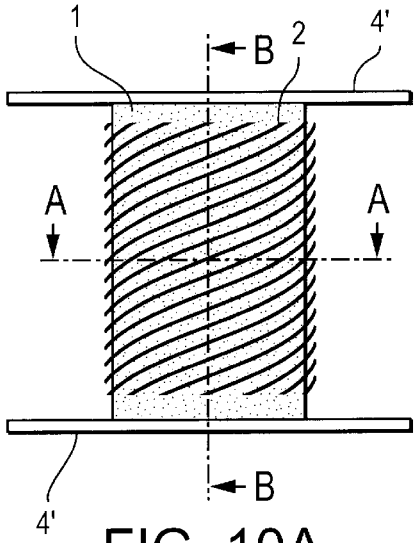
FIG. 10A is a view of a resonator according to a third embodiment of the present invention.
Figure 10B:
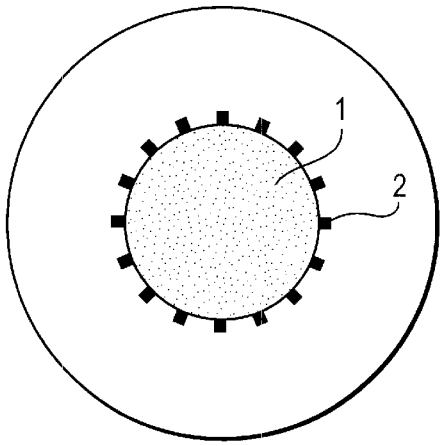
FIG. 10B is a cross-sectional view of the resonator taken along the line A—A of FIG. 10A.
Figure 10C:
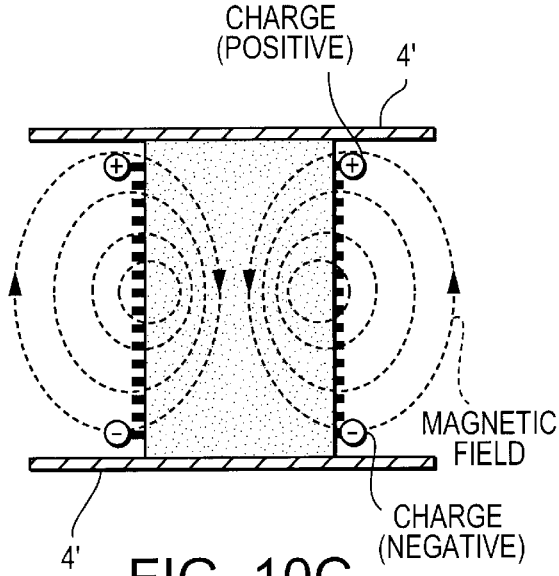
FIG. 10C is a cross-sectional view of the resonator taken along the line B—B of FIG. 10A, showing the distribution of the electromagnetic field of the resonator.

FIGS. 10A to 10C show a resonator according to. a third embodiment of the present invention. A resonator of this type includes a resonator element having the same configuration as in FIGS. 8A to 8C, and disc-shaped conductive shielding plates 4' which are laid over the upper and lower surfaces of the cylindrical dielectric element 1. There is a predetermined space between the conductive shielding plates 4' and the open ends of each helical line 2. FIG. 10C is a cross-sectional view of the resonator taken along the line B—B of FIG. 10A, and shows the electromagnetic field distribution thereof. The electromagnetic field generated by the helical lines 2 is shielded by the conductive shielding plates 4' so that unwanted emission to the outside and unwanted coupling to the outside are prevented.

Figure 11A:
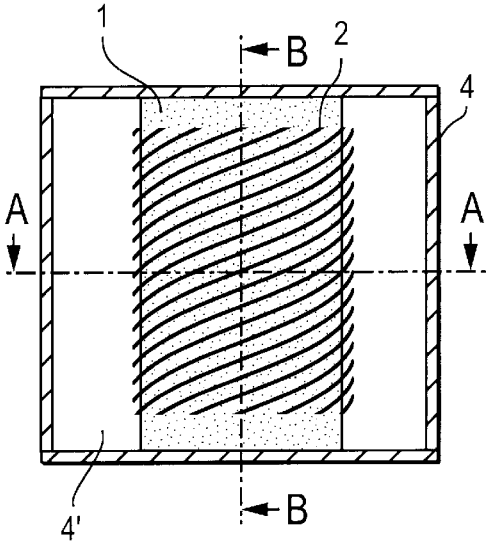
FIG. 11 A is an elevational view of a resonator according to a fourth embodiment of the present invention.
FIGS. 11B and 11C are cross-sectional views of the resonator taken along the lines A—A and B—B of FIG. 11A, respectively.
Figure 11B:
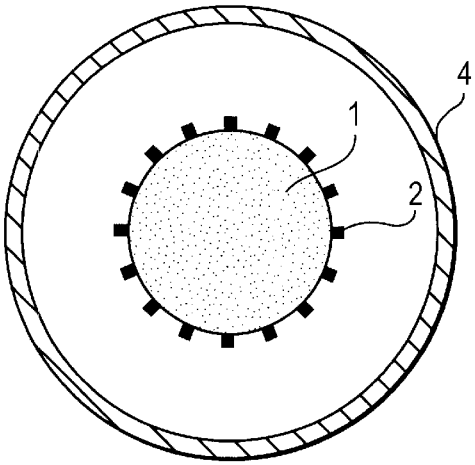
Figure 11C:
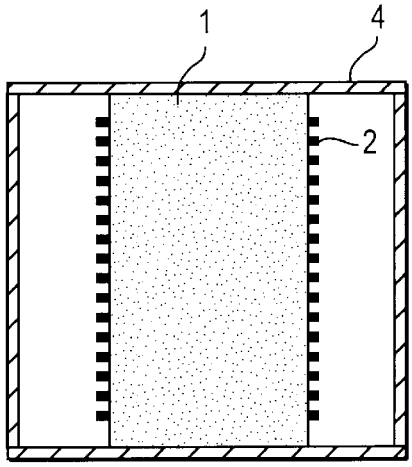

FIGS. 11A to 11C show a resonator according to a fourth embodiment of the present invention. This resonator is of the type in which a resonator element having the same configuration as in FIGS. 8A to 8C is disposed in a conductive cavity 4. There is a predetermined space between the conductive cavity 4 and the open ends of each helical line 2. The resonator according to the fourth embodiment thus includes a central conductor formed of a multiple helical line unit having open ends, wherein predetermined stray capacitance is generated between the open ends and the ground.

In the illustrated example, since the side surface of the dielectric element 1 on which the multiple helical line unit is formed is also shielded, a higher shielding effect can be achieved than in the example shown in FIGS. 10A to 10C.

The resonators illustrated in FIGS. 10A to 10C and FIGS. 11A to 11C are different from a typical coaxial resonator in that the cylindrical dielectric element 1 contributes to the resonance space, whereby the current concentration is moderated, resulting in a high Q-factor.

A resonator according to a fifth embodiment of the present invention is now described with reference to FIGS. 12A to 12D.

Figure 12A:
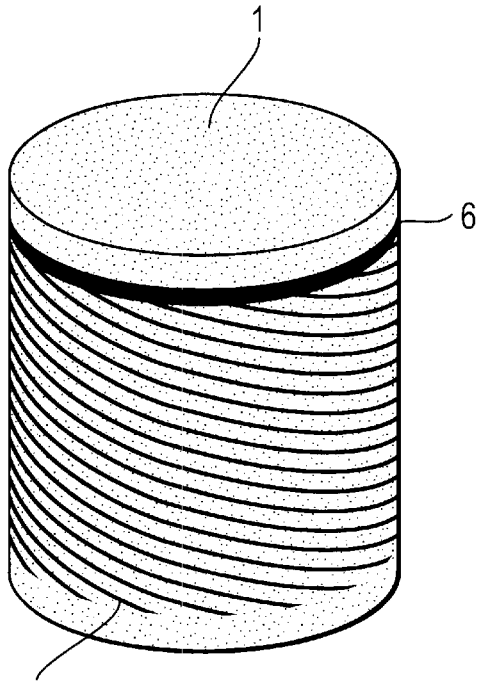
FIGS. 12A to 12D are perspective views of a resonator and modifications thereof according to a fifth embodiment of the present invention.
Figure 12B:
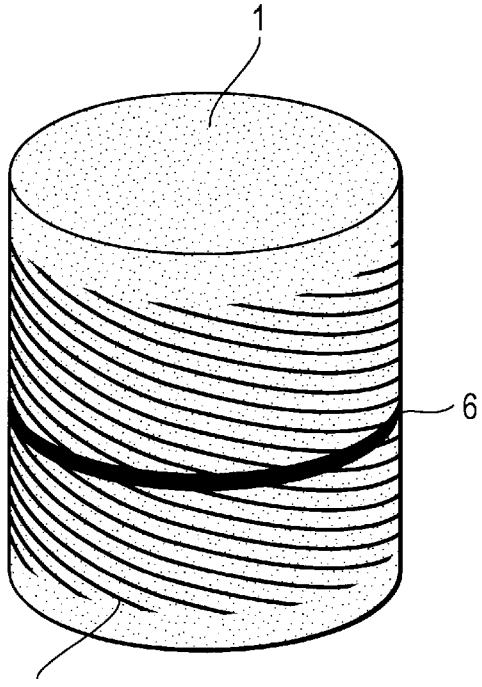
Figure 12C:
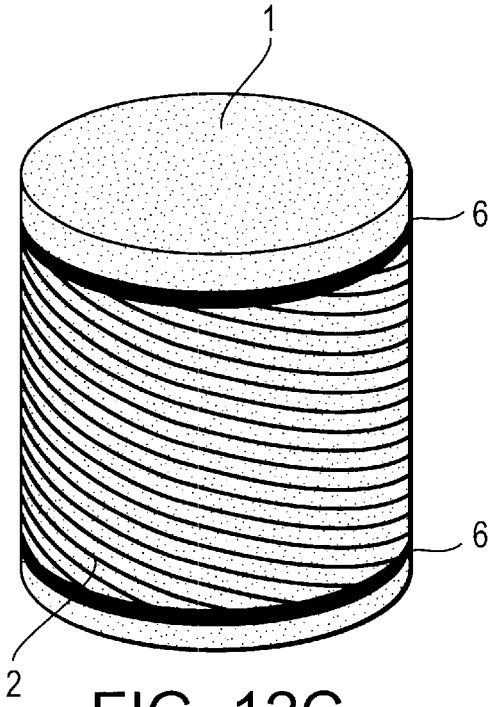
Figure 12D:
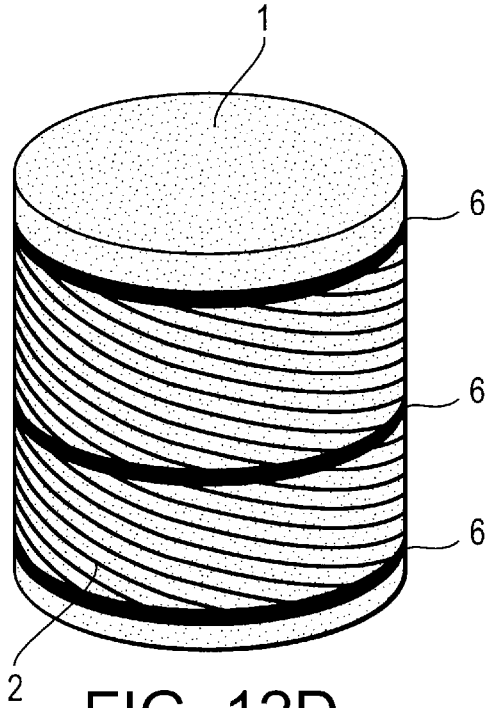

Four different types of resonator having connecting line(s) at equi-phase region(s) are illustrated in FIGS. 12A to 12D. FIG. 12A is a perspective view of a resonator including a cylindrical dielectric element 1 and a multiple helical line unit formed on a lateral face of the dielectric element 1, which includes a plurality of helical lines 2. The helical lines 2 are commonly connected by an annular line 6 at one equi-phase region, namely, one end region. FIG. 12B is a perspective view of another resonator in which the helical lines 2 are commonly connected by a line 6 at the middle region. FIG. 12C is a perspective view of another resonator in which the helical lines 2 are commonly connected by lines 6 at both end regions. The helical lines 2 may be commonly connected by lines 6 at any equi-phase region or regions, and FIG. 12D shows a resonator in which the helical lines 2 are commonly connected by lines 6 at both end regions and at the middle region.

Since the helical lines 2 are commonly connected at certain equi-phase region(s), the connected region(s) of the helical lines 2 are at a uniform potential, suppressing higher modes. In the resonator shown in FIGS. 12A, 12C or 12D, in which the helical lines 2 are circumferentially connected at an open end region(s), the circumferential cross-section of the electrode(s) is greater. Thus, what is required is to provide external-coupling electrodes in close proximity to the line(s) 6 in order to attain strong coupling to an external circuit, facilitating strong coupling to the outside, if necessary.

Various adaptations of the resonator in which the multiple helical line unit is formed with one or more connecting lines on a lateral face of the cylindrical dielectric element are illustrated in FIGS. 12A to 12D. However, the present invention is not limited thereto, and the resonator shown in FIGS. 1A, 1B and 2 may equally be employed, in which the multiple helical line unit is formed in the hole formed in the dielectric element. In other words, the helical lines arranged in the hole may be commonly connected by annular lines at any equi-phase region.

Figure 13A:
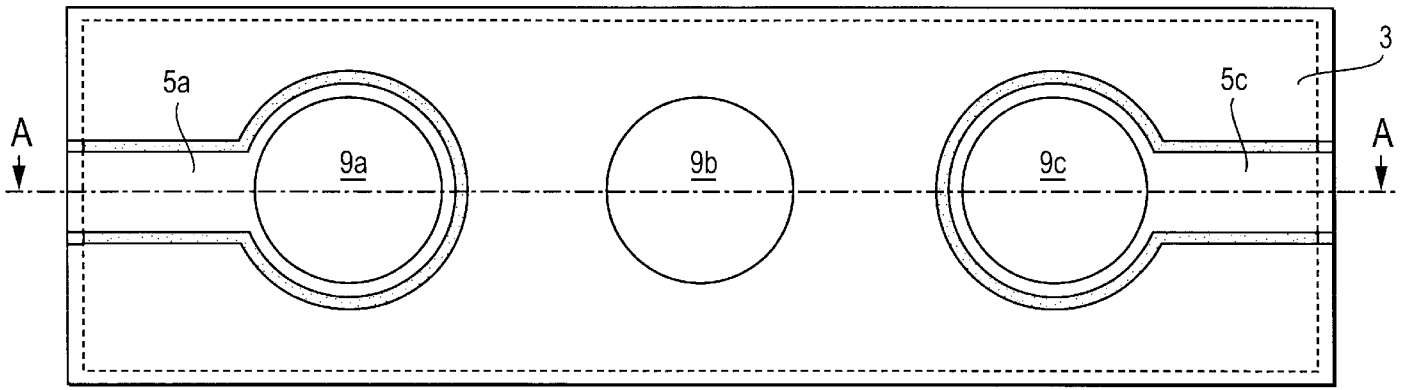
FIG. 13A is a plan view of a filter according to a sixth embodiment of the present invention.

A filter according to a sixth embodiment of the present invention is now described with reference to FIGS. 13A and 13B. FIG. 13A is a top plan view of the filter, and FIG. 13B is a cross-sectional view thereof taken along the line A—A in FIG. 13A.

A dielectric element (dielectric block) 1 having a substantially rectangular shape has three holes 9*a*, 9*b*, and 9*c*, and multiple helical line units 2*a*, 2*b*, and 2*c* each including a plurality of helical lines are formed in the holes 9*a*, 9*b*, and 9*c*, respectively. The dielectric element 1 further includes input/output electrodes Sa and 5*c* extending from its outer surface to one opening of the hole 9*a*and to one opening of the hole 9*c*, respectively. A ground electrode 3 is formed on almost the entirety of the outer surface of the dielectric element 1 except for the regions on which the input/output electrodes 5*a* and 5*c* are formed. When the filter is mounted on a circuit substrate with electronic components, etc., the surface on which the input/output electrodes 5*a* and 5*c* are formed is used as a mounting surface in a surface-mounting technique.

Figure 13B:
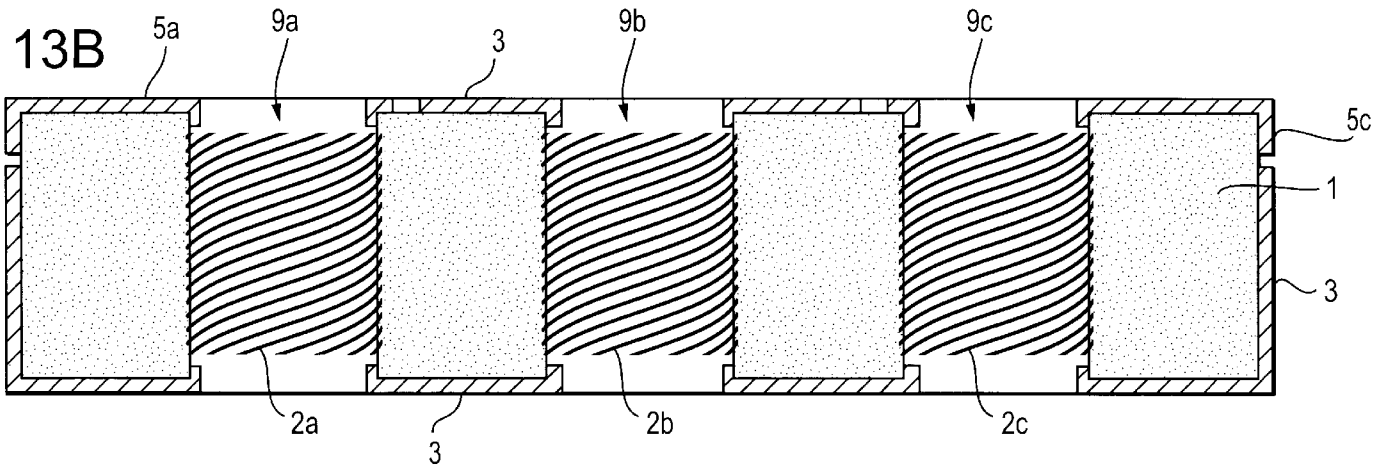
FIG. 13B is a cross-sectional view of the filter taken along the line A—A of FIG. 13A.

In the example illustrated in FIGS. 13A and 13B, the multiple helical line units 2*a*to 2*c*formed in the holes 9*a*, 9*b*, and 9*c*are used as triple dielectric coaxial resonators in combination with the dielectric element 1 and the ground electrode 3. The adjacent resonators in the triple resonators are electromagnetically coupled to each other. One open end of the multiple helical line unit 2*a* formed in the hole 9*a*is capacitively coupled to an annular portion of the input/output electrode 5*a*. Also, one open end of the multiple helical line unit 2*c* formed in the hole 9*c* is capacitively coupled to an annular portion of the input/output electrode 5*c*.

The thus constructed filter therefore has band-pass characteristics using the triple resonators.

Figure 14A:
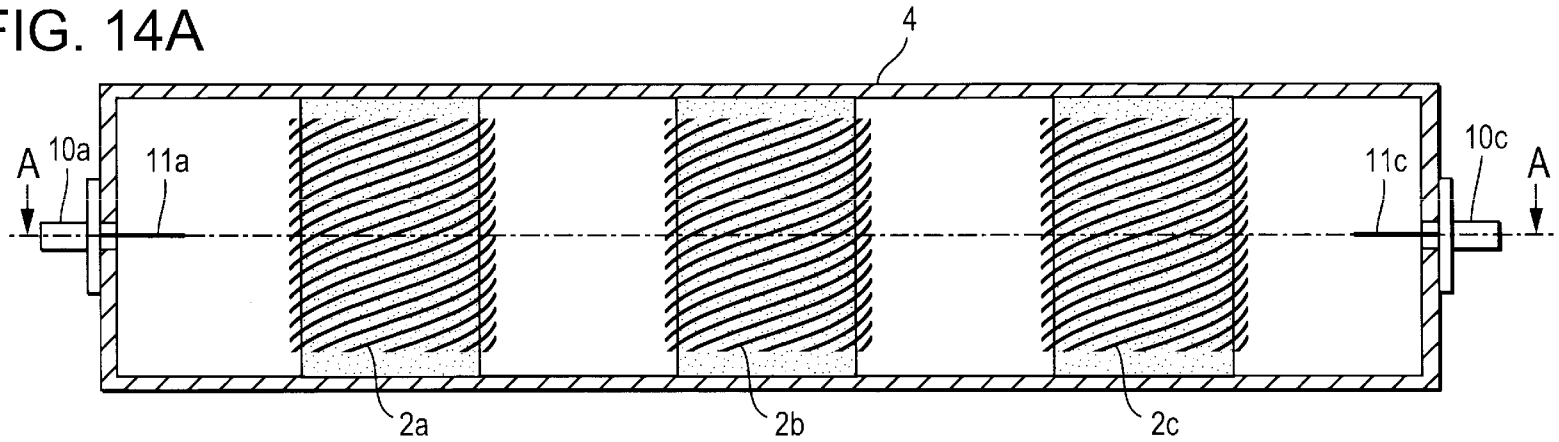
FIG. 14A is an elevational view of a filter according to a seventh embodiment of the present invention.
Figure 14B:
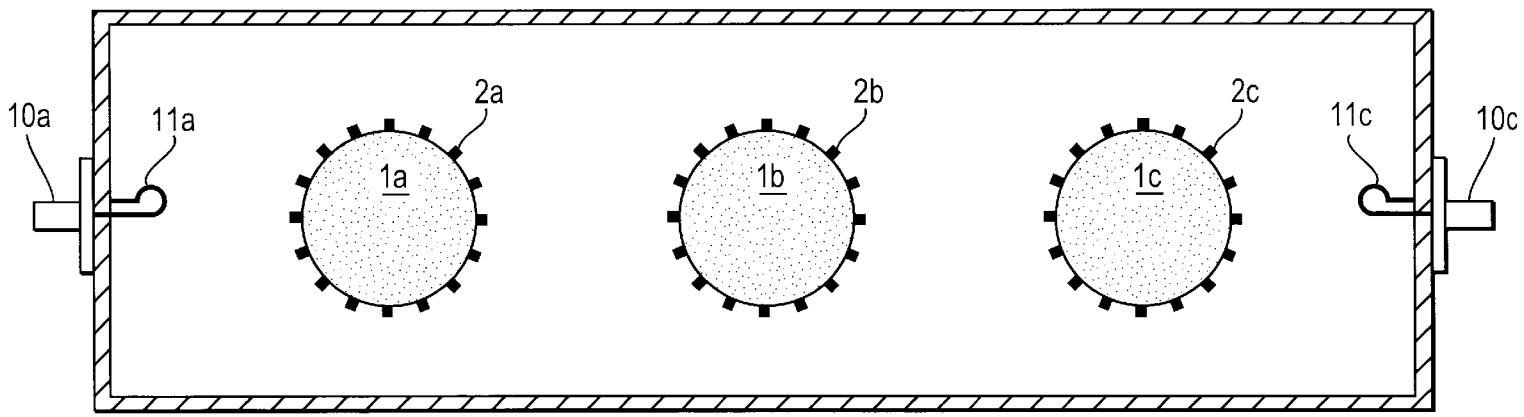
FIG. 14B is a cross-sectional view of the filter taken along the line A—A of FIG. 14A.
Figure 15C:
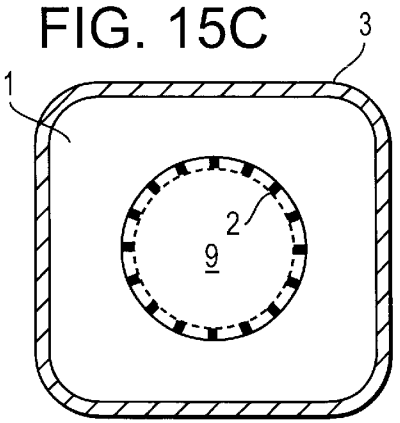
FIGS. 15B and 15C are cross-sectional views of the filter taken along the lines A—A and B—B of FIG. 15A, respectively.
Figure 15D:
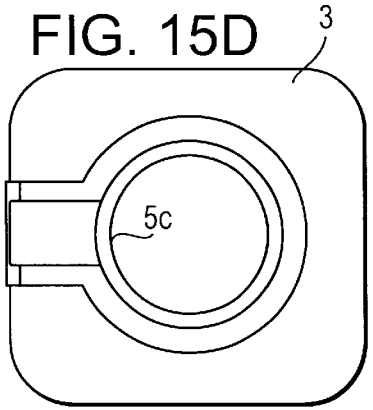
FIG. 15D is a side of the filter.
Figure 15B:
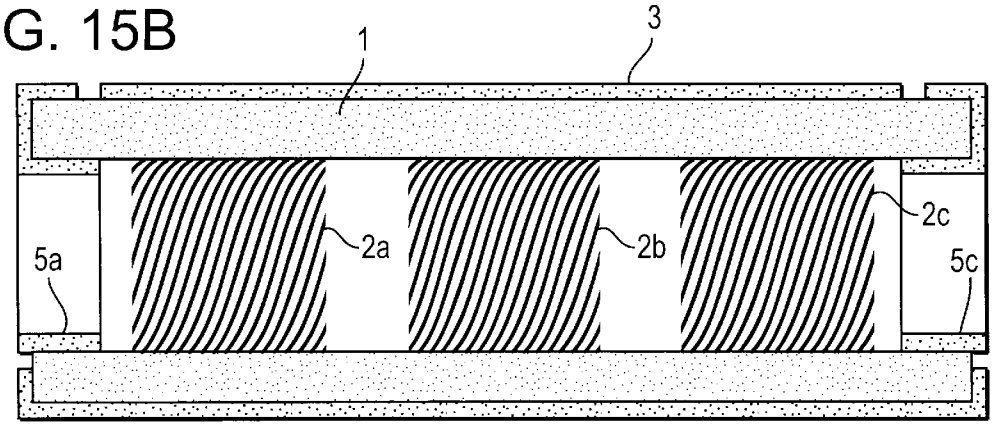
Figure 15A:
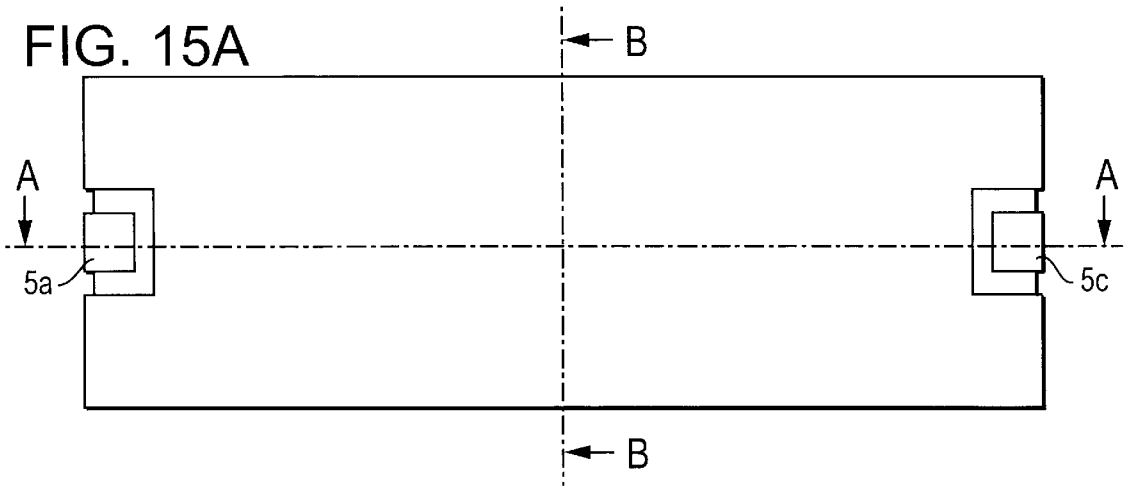
FIG. 15A is a top plan view of a filter according to an eighth embodiment of the present invention.

FIGS. 14A and 14B show a filter according to a seventh embodiment of the present invention.

In the illustrated example, the filter includes three cylindrical dielectric elements 1*a*, 1*b*and 1*c*, and multiple helical line units 2*a*to 2*c*each including a plurality of helical lines are formed on lateral faces of the dielectric elements 1 a to 1*c*, respectively, to form three resonators. These resonators are installed in a conductive cavity 4, forming triple coaxial resonators. The cavity 4 is provided with coaxial connectors 10*a* and 10*c*, and coupling loops 11*a* and 11*c* are, respectively, formed from the central conductors of the coaxial connectors 10*a* and 10*c* and through the inner wall of the cavity 4. The coupling loops 11*a*and 11*c* are oriented perpendicular to the axial direction of the cylindrical dielectric elements 1*a*, 1*b*, and 1*c*, as shown in FIG. 14B. Thus, the coupling loops 11*a* and 11*c* most strongly excite the magnetic field of the cylindrical dielectric elements 1*a*, 1*b*, and 1*c* in their axial components.

The thus constructed filter therefore has band-pass characteristics using the triple resonators.

A filter according to an eighth embodiment of the present invention is now described with reference to FIGS. 15A to 15D.

In the illustrated example, a dielectric element 1 has a hole 9 extending lengthwise therein, and multiple helical line units 2*a*, 2*b*, and 2*c* each including a plurality of helical lines are coaxially formed in the hole 9. The dielectric element 1 further includes input/output electrodes 5*a* and 5*c* extending from an outer surface thereof to a predetermined depth of the hole 9. A ground electrode 3 is formed on the outer surface of the dielectric element 1 except for the regions on which the input/output electrodes 5*a* and 5*c* are formed.

The multiple helical line units 2*a* to 2*c* are each used as half-wave coaxial resonators in combination with the dielectric element 1 and the ground electrode 3.

The adjacent resonators are capacitively coupled to each other, and the resonators formed of the helical line units 2*a* and 2*c* are coupled to the input/output electrodes 5*a* and 5*c*, respectively. The filter therefore has band-pass characteristics using the triple resonators.

Figure 16C:
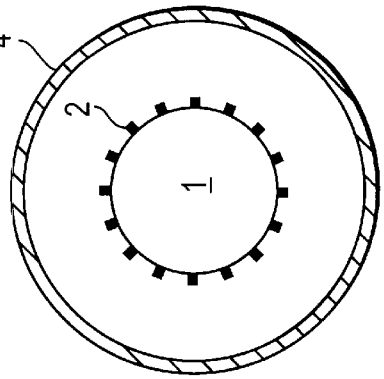
FIGS. 16B and 16C are cross-sectional views of the filter taken along the lines A—A and B—B of FIG. 16A, respectively.
Figure 16A:
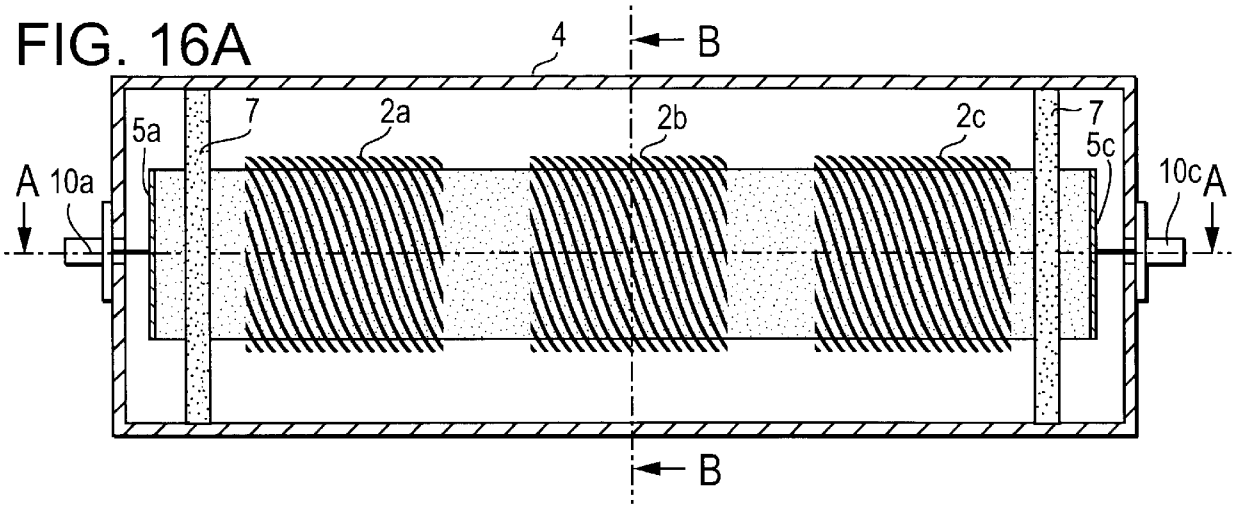
FIG. 16A is an elevational view of a filter according to a ninth embodiment of the present invention.
Figure 16B:
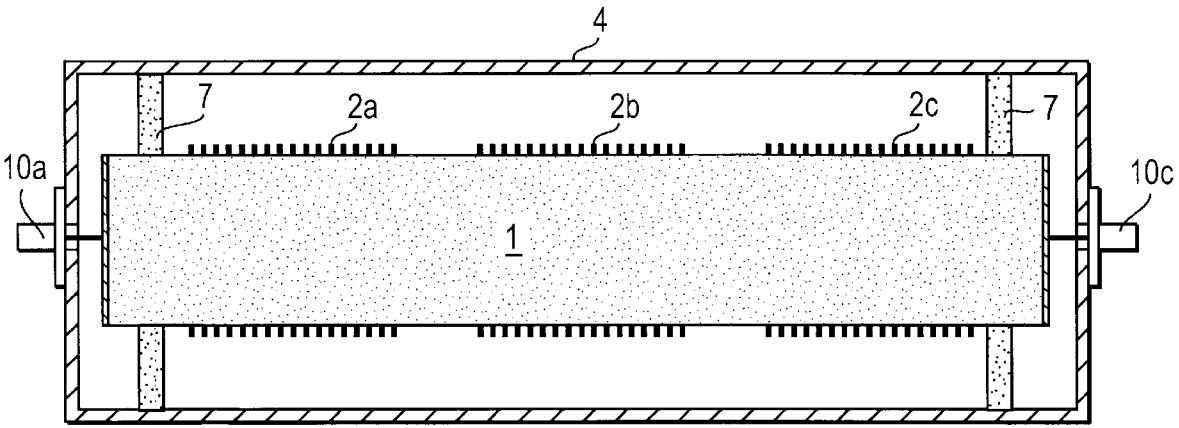

FIGS. 16A to 16C illustrate a filter according to a ninth embodiment of the present invention.

In the illustrated example, three multiple helical line units 2*a*, 2*b* and 2*c* each including a plurality of helical lines are formed on a lateral face of a cylindrical dielectric element 1, and input/output electrodes 5*a* and 5*c* are formed at opposing ends of the dielectric element 1. The dielectric element 1 is contained in a conductive cavity 4, and is supported by insulating or dielectric supporting members 7. The conductive cavity 4 is provided with coaxial connectors 10*a* and 10*c* having central conductors connected to the input/output electrodes 5*a* and 5*c*, respectively. The electrodes 5*a* and 5*c* may be circular disks or have any other shape that is suitable for coupling with the respective resonators.

The multiple helical line units 2*a* to 2*c* are used as coaxial resonators in combination with the conductive cavity 4, and the adjacent resonators are capacitively coupled to each other. Further, the resonators 2*a* and 2*c* are capacitively coupled to the input/output electrodes 5*a* and 5*c*, respectively. The filter therefore has band-pass characteristics using the triple resonators.

In addition, the open end and/or middle regions of the helical lines shown in FIGS. 13A to 16C may be commonly connected by lines at certain equi-phase portions, as shown in FIGS. 12A–12D. Then, the adjacent resonators would be more 2 5 strongly coupled to each other and the resonators would be more strongly coupled to the corresponding input/output electrodes 5*a* and 5*c*.

Some other modifications of the lines of the multiple helical line unit are described with reference to FIGS. 17 to 20, which are cross-sectional views of the modified helical lines.

Figure 17:
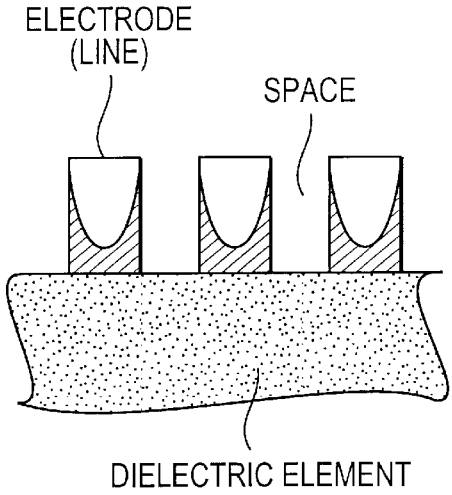
FIG. 17 is an enlarged cross-sectional view of helical lines of the resonator according to a tenth embodiment of the present invention.

In a modification shown in FIG. 17, the line width is equal to or narrower than the skin depth of the conductor. As a result, the electric currents interfere to maintain the magnetic flux passing through the space, so that reactive current having a phase deviating from the resonant phase may be reduced. As a result, the power loss can be remarkably reduced.

Figure 18:
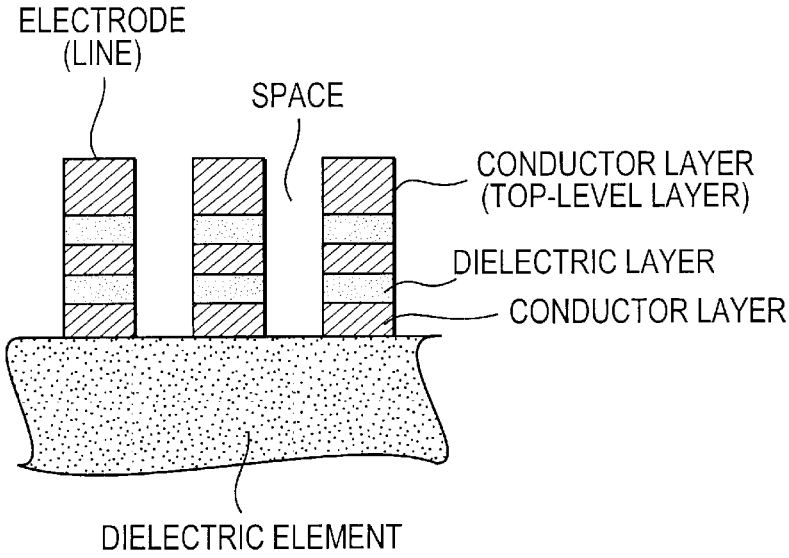
FIG. 18 is an enlarged cross-sectional view of helical lines of the resonator according to an eleventh embodiment of the present invention.

In FIG. 18, a thin film conductor layer, a thin film dielectric layer, a thin film conductor layer, and a thin film dielectric layer are in turn laminated on a dielectric element, on which a conductor layer is then formed, so that a single line having a three-layer structure is formed as a multi-layered thin film electrode. Such a multi-layered thin film electrode extending in the direction of thickness from the interface with the substrate allows the skin effect to be moderated, thus further reducing losses in the conductors.

Figure 19:
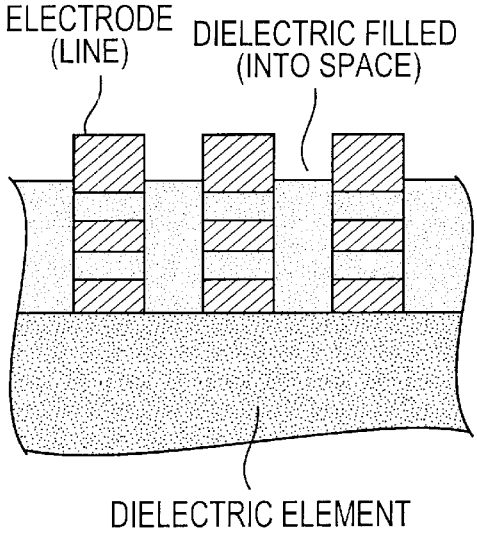
FIG. 19 is an enlarged cross-sectional view of helical lines of the resonator according to a twelfth embodiment of the present invention.

In FIG. 19, a dielectric material is filled into the spaces between the multi-layered thin film electrodes shown in FIG. 18. With this structure, short-circuits between adjacent lines and short-circuits between the layers are readily prevented, whereby reliability is improved and the characteristics are made stable.

Figure 20:
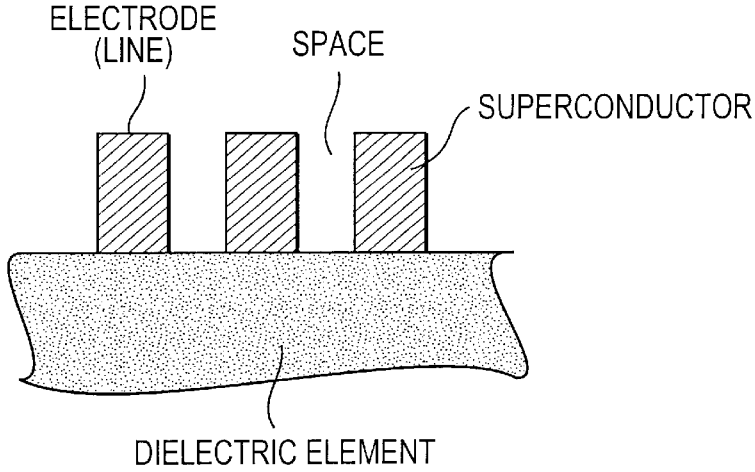
FIG. 20 is an enlarged cross-sectional view of helical lines of the resonator according to a thirteenth embodiment of the present invention.

In FIG. 20, a line electrode is made of a superconductor. The electrode is made of, for example, a high-temperature superconducting material such as yttrium or bismuth. When such a superconducting material is used for the electrode, typically, the upper limit of the current density is determined so that a high power tolerance may be maintained. However, the use of a multiple helical line unit would provide substantially edgeless lines so that significant current concentration is prevented, thereby facilitating operation at a level lower than the critical current density of the superconductor. The low loss characteristics of the superconductor are thus advantageously utilized.

Figure 21:
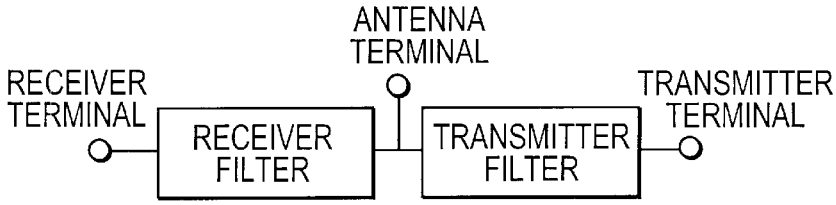
FIG. 21 is a block diagram of a duplexer according to the a fourteenth embodiment of present invention.

An example of a duplexer is now described with reference to FIG. 21.

In order to form a duplexer for use as a shared antenna device using any of the above-described filters, a receiver filter for passing. signals in a reception frequency band and for blocking signals in a transmission frequency band may be provided in combination with a transmitter filter for passing signals in a transmission frequency band and for blocking signals in a reception frequency band. This type of duplexer is shown in FIG. 21.

The two filters may be separate, or these filters may be assembled integrally. Specifically, in the case of the configuration shown in FIGS. 13A and 13B or FIGS. 15A to 15D, a multiple helical line unit for the receiver filter and another multiple helical line unit for the transmitter filter may be placed into the dielectric block 1, and input/output electrodes may be provided for an input terminal for transmission signals, an output terminal for reception signals, and an antenna terminal.

In the case of the configuration shown in FIGS. 14A and 14B, a multiple helical line unit for a receiver filter and another multiple helical line unit for a transmitter filter may be installed in a single conductive cavity, and coaxial connectors may be provided for the input of transmission signals, the output of reception signals, and an antenna.

Figure 22:
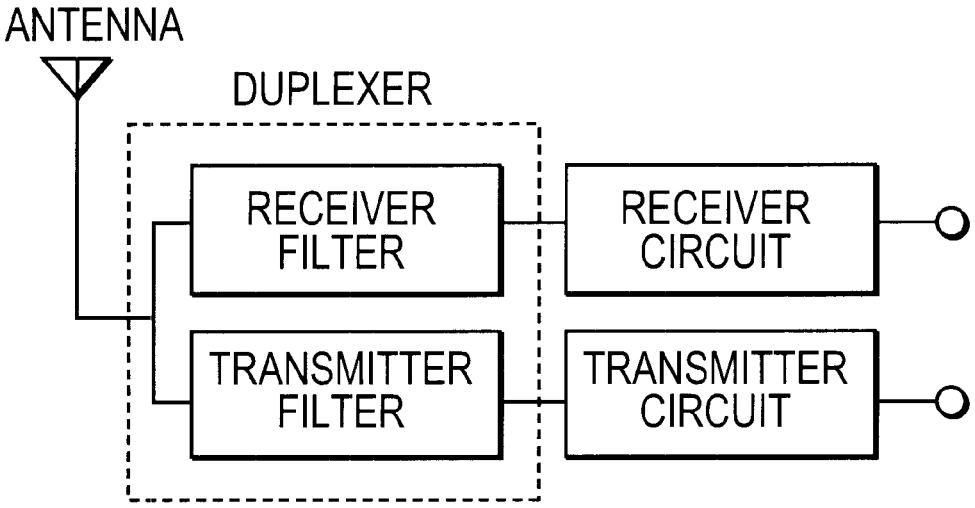
FIG. 22 is a block diagram of a communication device according to a fifteenth embodiment of the present invention.

Therefore, the transmission signals are prevented from being fed to a receiver circuit while the reception signals are prevented from being fed to a transmitter circuit. In addition, only the transmission signals in the transmission frequency band from the transmitter circuit are passed to an antenna, and only the reception signals in the receiving frequency band from the antenna are passed to the receiver circuit. FIG. 22 is a block diagram showing a communication device according to the present invention.

A duplexer used in the communication device is implemented by the above-described duplexer as a shared antenna device. A transmitter circuit and a receiver circuit are formed on a circuit substrate (not shown) in the communication device. The duplexer is mounted on the circuit substrate such that the transmitter circuit and the receiver circuit are, respectively, connected to an input terminal of the transmitter filter and an output terminal of the receiver filter, and the antenna is connected to an ANT terminal.

Although the present invention has been described through illustration of several preferred forms, it is to be understood that the described embodiments are only illustrative and various changes and modifications may be imparted thereto without departing from the scope of the present invention.

What is claimed is:

1. A resonator comprising:

a hollow dielectric element having a hole therein;

a helical line unit including a plurality of helical lines formed on a surface of the hole; and a ground electrode formed on an outer surface of the dielectric element.

2. A resonator according to claim 1, wherein said plurality of helical lines are interconnected by a line at a substantially equi-phase region of said helical lines.

3. A resonator according to any one of claims 1 and 2, wherein a line width of said helical lines is no greater than a skin depth at the frequency of a signal applied to said helical lines.

4. A resonator according to any one of claims 1 and 2, wherein each said helical line comprises a multi-layered thin film electrode.

5. A resonator according to claim 4, wherein a dielectric material is filled into spaces between adjacent said multi-layered thin film electrodes.

6. A resonator according to any one of claims 1 and 2, wherein a dielectric material is filled into spaces between adjacent said multilayered thin film electrodes.

7. A resonator according to any one of claims 1 and 2, wherein said helical lines comprise a superconducting material.

8. A resonator according to claim 2, wherein said plurality of helical lines are interconnected by a line at an end of said helical line unit.

9. A resonator according to claim 8, wherein said plurality of helical lines are interconnected by a line at a central region of said helical line unit.

10. A resonator according to claim 2, wherein said plurality of helical lines are interconnected by a pair of respective lines at each of two opposite ends of said helical line unit.

11. A resonator according to claim 10, wherein said plurality of helical lines are interconnected by a line at a central region of said helical line unit.

12. A resonator according to claim 2, wherein said plurality of helical lines are interconnected by a line at a central region of said helical line unit.

13. A filter comprising:

a dielectric element having a plurality of holes having different axes and being arranged substantially in parallel to each other;

a plurality of resonators formed respectively in said plurality of holes by a corresponding plurality of helical lines formed on a surface of the holes, each helical line unit including a plurality of helical lines; and a ground electrode formed on an outer surface- of the dielectric element; and input/output electrodes coupled to predetermined resonators of said plurality of resonators.

14. A filter according to claim 13, wherein said plurality of helical lines in each resonator are interconnected by a line at a substantially equi-phase region of said helical lines.

15. A filter comprising:

a dielectric element having a hole therein;

a plurality of resonators formed in said hole by a corresponding plurality of helical line units coaxially formed on a surface of the hole, each helical line unit including a plurality of helical lines; and a ground electrode formed on an outer surface of the dielectric element; and input/output electrodes coupled to predetermined resonators of said plurality of resonators.

16. A filter according to claim 15, wherein said plurality of helical lines in each said resonator are interconnected by a line at a substantially equi-phase region of said helical lines.

* * * * *